US008539922B2

(12) United States Patent
Brown et al.

(10) Patent No.: US 8,539,922 B2
(45) Date of Patent: Sep. 24, 2013

(54) RIGID PRIMER BULB PUMP

(75) Inventors: Christopher Brown, Merritt Island, FL (US); Marvin Peplow, Bartlett, IL (US)

(73) Assignee: Bluskies International, Inc., Bartlett, IL (US)

( * ) Notice: Subject to any disclaimer, the term of this patent is extended or adjusted under 35 U.S.C. 154(b) by 926 days.

(21) Appl. No.: 12/622,731

(22) Filed: Nov. 20, 2009

(65) Prior Publication Data

US 2011/0083629 A1 Apr. 14, 2011

Related U.S. Application Data

(63) Continuation-in-part of application No. 12/313,268, filed on Nov. 18, 2008, now Pat. No. 8,069,830.

(60) Provisional application No. 61/065,175, filed on Feb. 8, 2008.

(51) Int. Cl.
*F02M 1/16* (2006.01)
*F04B 39/00* (2006.01)

(52) U.S. Cl.
USPC ..... 123/179.11; 417/199.2; 417/454

(58) Field of Classification Search
USPC ..... 123/179.7–179.11; 417/199.2, 454
See application file for complete search history.

(56) References Cited

U.S. PATENT DOCUMENTS 4,722,263 A * 2/1988 Valentin ..... 92/13.7
7,431,575 B2 * 10/2008 Hawkins et al. ..... 417/440
8,069,830 B2 * 12/2011 Brown et al. ..... 123/179.11
2004/0020533 A1 * 2/2004 Engle ..... 137/202
2004/0178519 A1 9/2004 Krilin et al.
2006/0071030 A1 * 4/2006 Laidler ..... 222/209
2007/0212239 A1 * 9/2007 Heil et al. ..... 417/437
2011/0088648 A1 * 4/2011 Brown et al. ..... 123/179.11
2011/0116956 A1 * 5/2011 Gill ..... 417/479

FOREIGN PATENT DOCUMENTS

EP 1925811 A1 5/2008
GB 2114237 A1 8/1983

OTHER PUBLICATIONS

International Search Report and Written Opinion of International Searching Authority, Sep. 30, 2010 for PCT/US2009/064667 (related to current case).

* cited by examiner

*Primary Examiner* — Mahmoud Gimie
*Assistant Examiner* — David Hamaoui
(74) *Attorney, Agent, or Firm* — Clifford Kraft

(57) ABSTRACT

A hand operated primer pump for small marine or other engines generally spark ignition engines used on stern drive boats that prevents transfer of hydrocarbons into the atmosphere. The primer generally mimics and replaces prior art rubber primer bulbs in general shape and possibly color, although it can be made in any shape or color. It generally contains a pump that delivers a precise measured amount of fuel with each stroke of the actuator. The primer can have an ergonomically designed actuator that creates the farthest distance from a fulcrum point for maximum leverage and hence, maximum ease of use. The primer is generally designed with a continuous molded fuel path to seal any source of hydrocarbon leakage as well as being made from materials that prevent transfer of hydrocarbons to the atmosphere.

12 Claims, 7 Drawing Sheets

RIGID PRIMER BULB PUMP

This application is a continuation-in-part of copending application Ser. No. 12/313,268 filed Nov. 18, 2008 which claimed priority from U.S. Provisional patent application No. 61/065,175 filed Feb. 8, 2008. Application Ser. Nos. 12/313,268 and 61/065,175 are hereby incorporated by reference.

BACKGROUND

1. Field of the Invention

The present invention relates to primers for marine engines and more particularly to a rigid primer bulb pump that does not emit any hydrocarbons.

2. Description of the Prior Art

Outboard mounted spark ignition marine engines used on stern drive boats currently employ a semi-rigid rubber primer bulb type pumping device to provide initial prime to the fuel supply system. These devices are simply rubber bulbs mounted on fuel hoses usually equipped with a set of one-way valves to direct the direction of pumping when the bulb is squeezed.

This type of prior art device, by nature of its makeup and material, is generally permeable. Because of that, it releases a small percentage of the hydrocarbons that pass through it into the atmosphere. It is very undesirable to pass any fuel hydrocarbons into the atmosphere since that represents a source of pollution and may violate future government regulations. It would be advantageous to have a primer for outboard mounted engines that was made from a rigid polymer and avoided this shortcoming by not allowing leakage or permeation of hydrocarbons into the atmosphere.

SUMMARY OF THE INVENTION

The present invention relates to a hand operated primer pump for small marine or other engines generally spark ignition engines used on stern drive boats that prevents transfer of hydrocarbons into the atmosphere. The primer of the present invention generally mimics and replaces prior art rubber primer bulbs in general shape and possibly color, although it can be made in any shape or color. It is generally made from rigid or semi-rigid polymer material. The primer of the present invention contains a pump that delivers a precise measured amount of fuel with each stroke of the actuator. The present invention can have an ergonomically designed actuator that creates the farthest distance from a fulcrum point for maximum leverage and hence, maximum ease of use. The primer of the present invention is designed to tightly fit together to seal any source of hydrocarbon leakage and generally to use a continuously molded fuel path as well as being made from materials that prevent transfer of hydrocarbons to the atmosphere.

DESCRIPTION OF THE FIGURES

Attention is directed to several illustrations that aid in understanding the present invention.

Several drawings and illustrations have been provided to help understand the invention. The scope of the present invention is not limited to what is shown in this figures.

DESCRIPTION OF THE INVENTION

Figure 1:
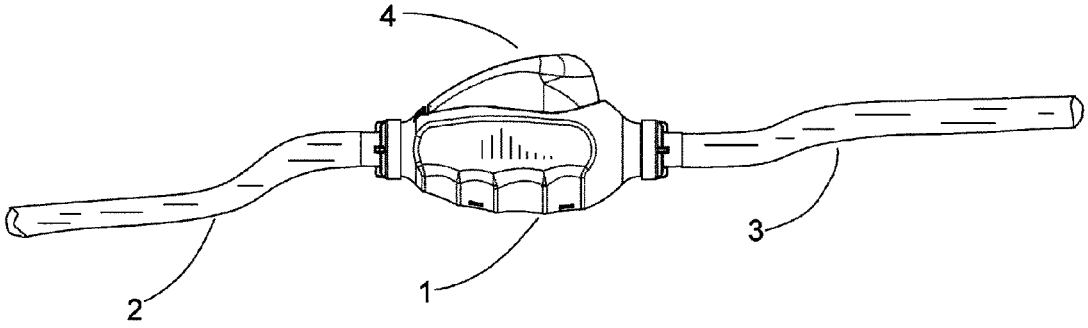
FIG. 1 shows a side view of an embodiment of the present invention.

The priming system of the present invention uses a hand squeeze or thumb press operation to pump fuel in one direction through the device by means of a piston pump 1 shown in FIG. 1. A supply hose 2 runs to a fuel tank to supply fuel to the system. An exit hose 3 runs to the engine. A hand or thumb squeeze actuator 4 is mounted on the top of the pump 1 and delivers a precisely measured amount of fuel to the engine when it is squeezed. While the pump is in the relaxed position, the engine can draw fuel through it from the tank in normal operation.

Figure 2A:
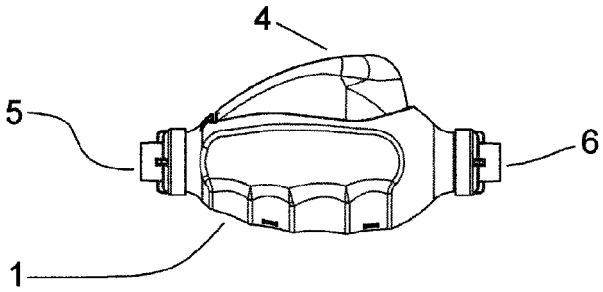
FIGS. 2A-2C show a side view, top view and rear end view of the embodiment of FIG. 1.
Figure 2B:
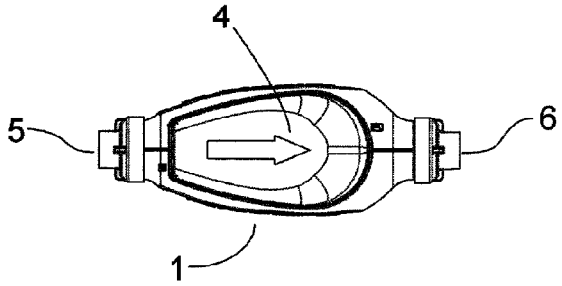
Figure 2C:
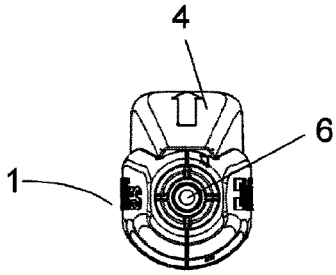

FIGS. 2A-2C show a side view, top view and rear end view of the embodiment of FIG. 1. A rear entrance orifice 5 and a front exit orifice 6 can be seen. Fuel hoses generally attach to these orifices. The actuator 4 is generally located at the top of the device and can be captured at a lower extremity on each side at two pivot points. The pivot points on the actuator 4 can be holes that correspond to a pair of protrusions molded onto the top of the lower fuel path section of the pump body 1. The actuator 4 can sit directly on top of a cup shaped piston guide, which in turn fits onto the outside surface of the generally cylindrical piston housing protruding extremity at the top of the pump body. The piston is either directly or indirectly affixed to a seal which is positioned inside the pump body cylinder bore facing downward towards the fuel path in the lower section of the pump body. A spring placed under tension between the piston assembly and a corresponding cylindrical cup shaped recess that can be molded in the lower extremity of the pump body.

Figure 3:
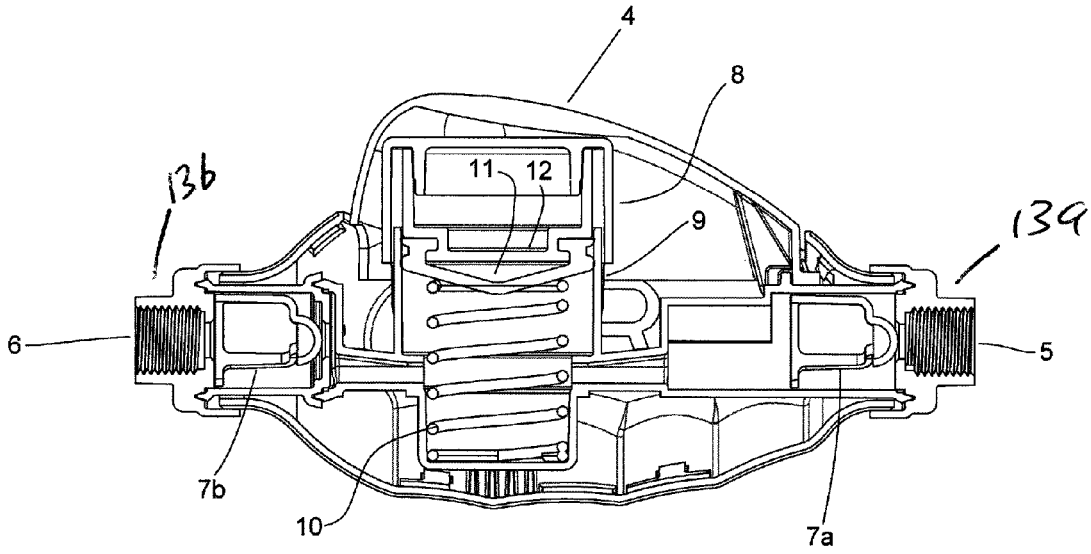
FIG. 3 shows a side sectional view of an embodiment of the present invention.
Figure 4:
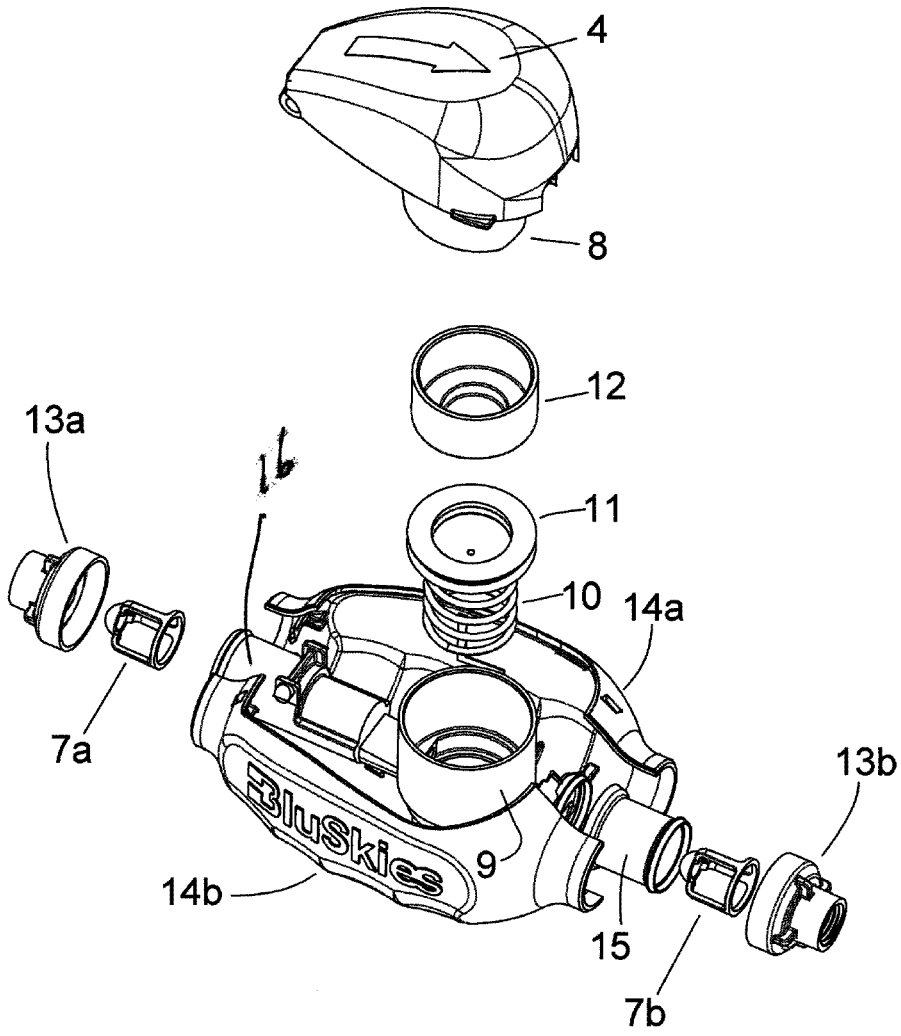
FIG. 4 shows an exploded view of the embodiment of FIG. 3.

FIG. 3 and FIG. 4 show a side sectional view and an exploded view of an embodiment of the pump mechanism of the present invention. Fuel enters the entrance orifice 5 in a molded entry fitting 13*a* where it encounters a entry check plunger 7*a*. A continuous channel connects the rear part of the pump to the front part allowing fuel to pass through the pump chamber 9 when the pump is in the relaxed position (as shown in FIG. 3). At the front of the pump, fuel can flow out through an exit check plunger 7*b* into an exit orifice 6 in a molded exit fitting 13*b*. The rear and front check plungers 7*a*, 7*b* act as one-way valves that prevent any reverse fuel flow during pumping. The check plungers 7*a*, 7*b* are facing in the same direction with a dome towards the direction from which the fuel will enter the pump body. The molded fittings 13*a* and 13*b* have a molded valve seat that corresponds to the domed end of the check plunger 7*a* or 7*b*.

The pump priming system of the present invention is designed primarily for a human hand to squeeze; however, it can be depressed by thumb, foot or other body extremity to cause the actuator 4 to depress by lever action around a fulcrum point and cause a piston guide 8 and piston assembly to displace the internal volume of mass in the pump cylinder bore.

The pump actuator 4 pushes a piston 12 downward against a spring 10 when squeezed by means of a piston guide 8 attached to the actuator. The piston 12 pushes a seal 11 down into the pump chamber or fuel path cylinder 9 causing the amount of fuel in the pump chamber to be forced out of the exit orifice 6 through the exit check plunger 7*b*. The volume of fuel in the bore travels into the fuel path underneath the cylinder. When the pump actuator 4 is released, the spring 10 causes the piston 8 and seal 11 to return to their relaxed position as shown in FIG. 3. However, as the piston and seal return upward, they draw a quantity of fuel in from the entrance orifice 5 through the entrance check plunger 7*a*. As previously stated, the entrance and exit check plungers 7*a*, 7*b* act as one-way valves allowing the pumping action to take place and not permitting any fuel flow in the opposite direction.

FIG. 4 also shows a possible construction of the pump using a pump central body 16, a left side housing 14*a*, a right side housing 14*b* and a molded check seat 15 to receive the exit check plunger 7*b*. The molded fittings 13*a* and 13*b* can optionally be identical for ease in manufacture. The left and right side housings 14*a*, 14*b* each can form a half-shell the fit together around the pump central body 16 and check plungers 71, 7*b*.

Figure 5:
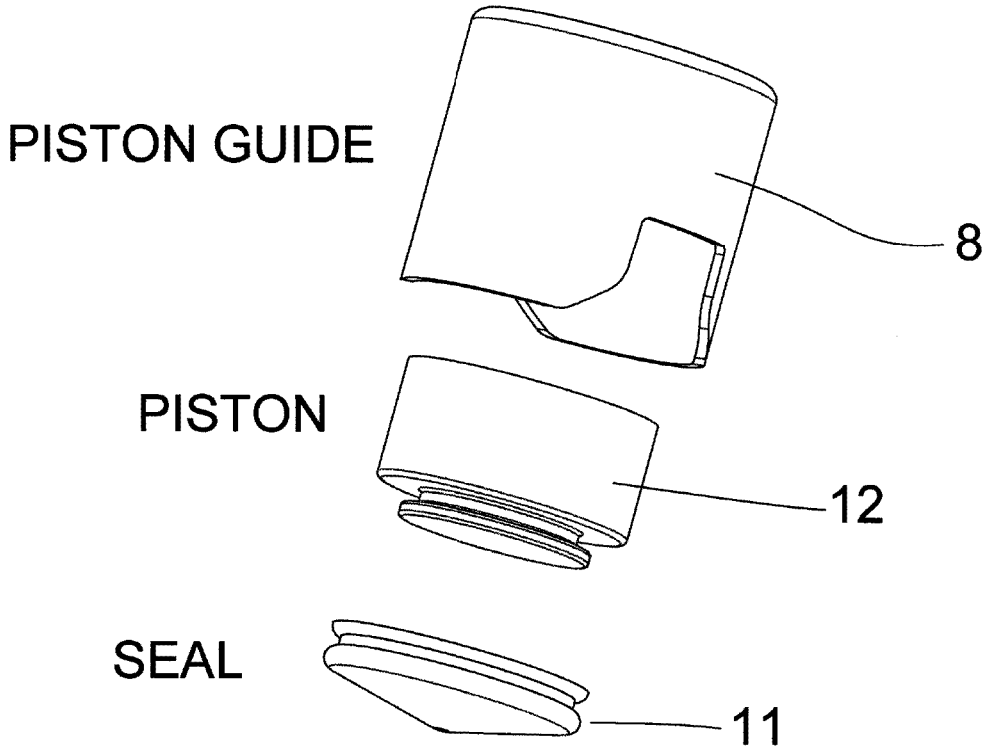
FIG. 5 shows an exploded side view of the piston guide, piston and seal from FIG. 4.

FIG. 5 shows a side exploded view of the relationship between the piston guide 8, the piston 12 and the seal 11.

Figure 6:
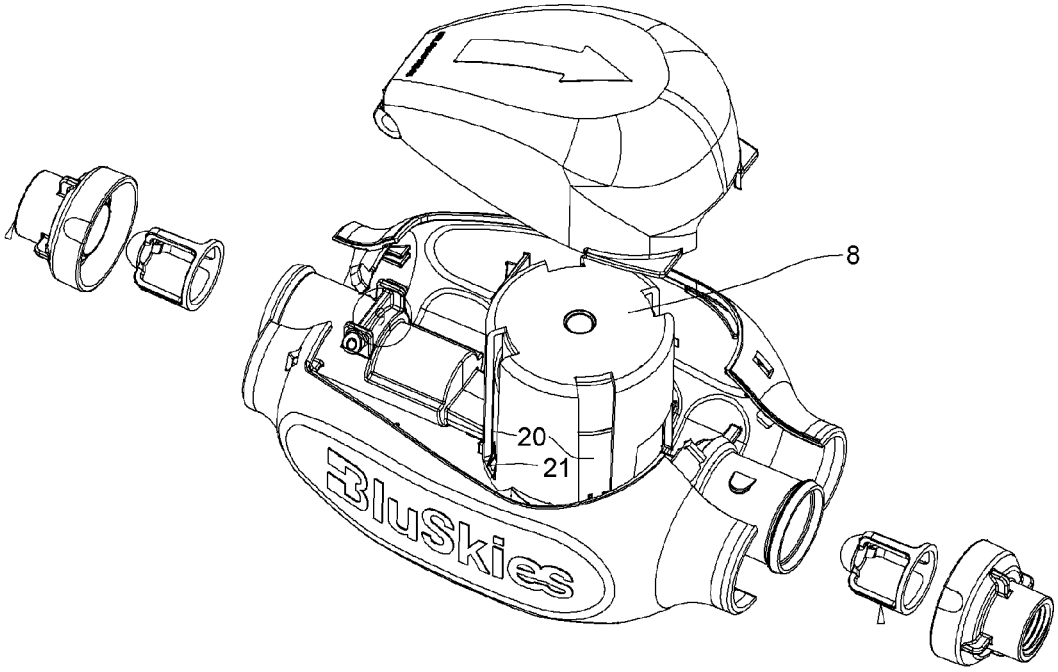
FIG. 6 is an exploded view of a different embodiment of the present invention.
Figure 7:
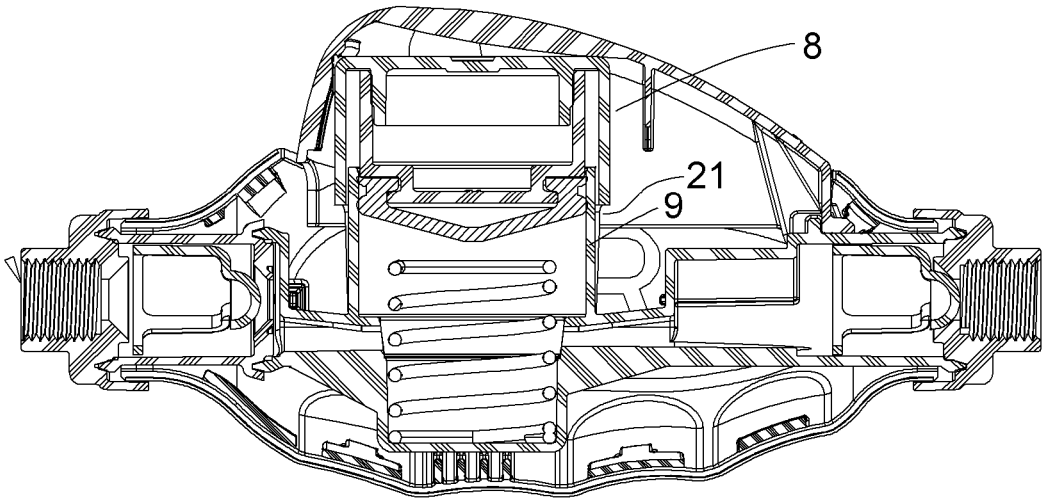
FIG. 7 is a sectional view of the embodiment of FIG. 6.

FIG. 6 shows a different embodiment of the present invention where four small tabs 21 have been added to the lower exterior surface of the fuel path cylinder wall 9, and corresponding slots 20 have been added to the piston guide 8. This can also be seen in FIG. 7 which is a cross section. The piston guide 8, when assembled to the fuel path cylinder snaps over these tabs. This allows full upward and downward movement with a definite stop at the uppermost travel point. These tabs 21 and slots 20 provide a positive locking mechanism the absolutely prevent the piston guide and the fuel path cylinder from coming apart. This can be an important safety feature.

As previously stated, the primer pump of the present invention can mimic current rubber primer bulbs in shape and color, although it can be made rectangular, tubular or any other shape and can be designed to be attached to a fuel tank, a marine engine or be mounted in-line with the fuel hose. The preferred material for the body of the present invention is polybutylene terephthalate (PBT), polycarbonate, polycarbonate PBT (PC/PBT) Nylon 6, acetal (acetyl), polyethylene's with nano-sized platelets that act as a hydrocarbon barrier or any rigid polymer material that meets federal low permeation standards of less than 15 g/sq. m./day. A preferred material is a polymer with an embedded layer of carbon or other platelet particles that prevent hydrocarbon transfer. Acetal is also a preferred material. The material used must generally be capable of being molded into components for assembly. It is essential that the molded components to either have no seams or to fit together in such a way that there is no leakage or transfer of hydrocarbons at any seams.

U.S. Government rules for marine fuel system hydrocarbon emissions are 0.4 g/gallon/day for diumal venting from a fuel tank at 35.6 degrees C.; 1.5 g/gallon/day permeation from a fuel tank at 40 degrees C.; and 15/g/sq. meter/day for hose and primer bulb permeation at 23 degrees C. (15 g/sq. meter/day with 15% methanol blend fuel). A test fuel of 10% ethonol and 90% indolene can be used for normal testing. The final primer assembly should meet these requirements. Acetal generally has a permeation of around 1.2 g/sq. meter/day, so for a fuel path with a surface area of around 10.6 sq. inches (0.00684 sq. m) for example, the total emission for the pump would be around 0.0082 g/day.

The primer spring can be made from stainless steel or from a polymer with the ability to compress and expand sufficiently to provide sufficient force. The seal can be made from a low permeation elastomer such as VITRON™ manufactured by DuPont Dow.

The primer pump of the present invention is made from several molded parts as has been described. These parts are together into a finished unit so that the final product meets permeation requirements. In particular, in a preferred embodiment, the fuel path is a continuous molded unit from the entry hose to the exit hose. The only opening is around the pump seal 11 and, of course, where the fuel lines terminate. The pump seal can be made from a low permeation elastomer as previously explained to keep hydrocarbon emission within limits.

While the primer of the present invention is intended primarily for fuels, it can also be used in any type of suction application such as the suction and delivery of any oils or other fluids needing priming, and particularly in the suction and delivery of any fluid needed to prime a fluid circuit, or pump fluid from a reservoir to another place.

Several descriptions and illustrations have been presented to aid in understanding the present invention. A person with skill in the art will understand that numerous changes and variations are possible without departing from the spirit of the invention. Each of these changes and variations is within the scope of the present invention.

We claim:

1. A primer pump for use on a fuel line for a marine engine comprising:

a rigid housing containing a pump body, a fuel flow path, an entrance check plunger at a first end of said fuel flow path and an exit check plunger on a second end of said fuel flow path, said fuel flow path connectable at each end to fuel hoses;

a rigid actuator pivotally attached to said housing, said actuator pressing on a spring-biased rigid piston and seal, said rigid piston and seal entering said pump body when said rigid actuator is depressed causing fuel contained in said pump body to flow into said fuel path;

and wherein said rigid actuator is mounted directly on top of a cup-shaped piston guide, which fits onto an outside surface of a generally cylindrical piston housing with a protruding extremity at an upper end of the pump body;

a first flexible hose connectable to a fuel supply attached to said first end of said fuel flow path;

a second flexible hose connectable to a marine engine attached to said second end of said fuel flow path;

a slot and tab mechanism between said piston guide and said pump body that prevents said piston guide from separating from said pump body.

2. The primer pump of claim 1 wherein said fuel flow path is made from material having a hydrocarbon permeation of less then around 15 g/sq. meter/day.

3. The primer pump of claim 1 wherein said seal is made from a low permeation elastomer.

4. The primer pump of claim 1 wherein said rigid housing comprises a right half shell and a left half shell, said shells closing around said pump body and check plungers.

5. The primer pump of claim 1 wherein said spring-biased rigid piston is biased by a stainless steel spring.

6. The primer pump of claim 1 wherein said spring-biased rigid piston is biased by a polymer spring.

7. The primer pump of claim 1 wherein said pump body and fuel-flow path are made from polybutylene terephthalate (PBT), polycarbonate, polycarbonate PBT (PC/PBT), Nylon 6, acetal (acetyl) or polyethylene's containing nano-sized platelets.

8. A primer pump for a marine engine comprising:

a rigid housing containing a pump body, a fuel flow path, an entrance check plunger at a first end of said fuel flow path and an exit check plunger on a second end of said fuel flow path, said fuel flow path connectable at each end to fuel hoses;

a rigid actuator pivotally attached to said pump body, said actuator pressing on a spring-biased rigid piston and seal, said rigid piston and seal entering said pump body when said rigid actuator is depressed causing fuel contained in said pump body to flow into said fuel path;

and wherein said rigid actuator is mounted directly on top of a cup-shaped piston guide, which fits onto an outside surface of a generally cylindrical piston housing with a protruding extremity at an upper end of the pump body;

a first flexible hose connectable to a fuel supply attached to said first end of said fuel flow path;

a second flexible hose connectable to a marine engine attached to said second end of said fuel flow path;

and wherein said fuel flow path is made from material having a hydrocarbon permeation of less then around 15 g/sq. meter/day and said seal is made from a low permeation elastomer.

9. The primer pump of claim 8 wherein said rigid housing comprises a right half shell and a left half shell, said shells closing around said pump body and check plungers.

10. The primer pump of claim 8 wherein said spring-biased rigid piston is biased by a stainless steel spring.

11. The primer pump of claim 8 wherein said spring-biased rigid piston is biased by a polymer spring.

12. The primer pump of claim 8 wherein said pump body and fuel-flow path are made from polybutylene terephthalate (PBT), polycarbonate, polycarbonate PBT (PC/PBT), Nylon 6, acetal (acetyl) or polyethylene's containing nano-sized platelets.

* * * * *